US005533482A

United States Patent [19]

Naitoh

[11] Patent Number: 5,533,482

[45] Date of Patent: Jul. 9, 1996

[54] FUEL INJECTION NOZZLE

[75] Inventor: Ken Naitoh, Yokohama, Japan

[73] Assignee: Nissan Motor Co., Ltd., Yokohama, Japan

[21] Appl. No.: 447,459

[22] Filed: May 23, 1995

[30] Foreign Application Priority Data

May 23, 1994 [JP] Japan ..... 6-107352

[51] Int. Cl.[6] ..... F02M 61/18

[52] U.S. Cl. ..... 123/305; 123/472; 239/467; 239/533.12; 239/585.1

[58] Field of Search ..... 123/294, 305, 123/470, 472; 239/463, 467, 533.2–533.12, 585.1–585.5

[56] References Cited

U.S. PATENT DOCUMENTS

| | | | |
|---|---|---|---|
| 3,368,761 | 2/1968 | Pelizzoni | 239/533 |
| 3,838,821 | 10/1974 | Berlyn | 239/533.7 |
| 4,208,014 | 6/1980 | Mueller | 239/533.4 |
| 4,540,126 | 9/1985 | Yoneda et al. | 239/533.4 |
| 4,578,164 | 3/1986 | Matsui et al. | 204/129.55 |
| 4,633,830 | 1/1987 | Oshima et al. | 123/472 X |

FOREIGN PATENT DOCUMENTS 0353657 2/1990 European Pat. Off. .

OTHER PUBLICATIONS

Patent Abstracts of Japan, "Fuel Injection Valve For Internal–Combustion Engine", Japanese 60–142051, Jul. 27, 1985.

Patent Abstracts of Japan, "Injection Valve", Japanese 60–261975, Dec. 25, 1985.

*Primary Examiner*—Tony M. Argenbright
*Attorney, Agent, or Firm*—Foley & Lardner

[57] ABSTRACT

A fuel injection nozzle for spraying a swirl of fuel, includes a nozzle body having a bore, an orifice communicated with the bore, and a wall defining the bore and the orifice. The bore for receiving an axially movable valve body has a first center axis and the orifice has a second center axis. An inlet open to the bore and an outlet open to outside the nozzle body. The wall includes a first circumferential edge portion defining the inlet of the orifice and a second circumferential edge portion defining the outlet of the orifice. A sprayed fuel body formed by fuel discharged from said orifice, has a third center axis. The first circumferential edge portion is so arranged as to allow the first center axis to be positioned inside the inlet. The second circumferential edge portion is so contoured as to allow at least a portion of the second circumferential edge portion to be out of a plane normal to the second center axis.

12 Claims, 14 Drawing Sheets

FUEL INJECTION NOZZLE

BACKGROUND OF THE INVENTION

The present invention relates to a fuel injection nozzle for use in an internal combustion engine.

There is generally known a fuel injection nozzle of so-called spiral swirl type in which fuel swirled in a nozzle body flows into an inlet of an orifice formed through the nozzle body and then sprays the swirled fuel out of an outlet of the orifice into a combustion chamber within an engine cylinder.

Japanese Patent Application First Publication No. 60-142051 discloses one example of such spiral swirl-type fuel injection nozzle. The fuel injection nozzle includes a nozzle body having an orifice disposed coaxially with the nozzle body. The orifice has an outlet contoured by a circumferential edge portion of the orifice and disposed on a plane normal to a center axis of the orifice. The orifice sprays a fuel such that the sprayed fuel constitutes a body having a center axis aligned with a center axis of the nozzle body.

The prior art fuel injection nozzle has been arranged in a limited space of the engine in such a way that a fuel sprayed from the orifice is directed to a central portion of a piston head in the engine cylinder. During spraying, intake valve heads within the engine cylinder are sprayed to be contacted with the fuel. The contact of the sprayed fuel disturbs smooth operation of the intake valves, resulting in decrease of combustion efficiency.

There have been made attempts to effectively spray fuel toward the piston head and prevent the intake valve heads From being in contact with the fuel sprayed. Japanese Patent Application First Publication No. 60-261975 discloses a spiral swirl-type fuel injection nozzle. This fuel injection nozzle includes a nozzle body having an orifice provided at a predetermined angle with respect to a center axis of the nozzle body. The orifice has a center axis offset from the center axis of the nozzle body. The fuel sprayed through the orifice forms a sprayed fuel body having a center axis offset from the center axis of the nozzle body. This arrangement allows the fuel to spray toward the piston head within the engine cylinder. However, since the center axis of the orifice is offset from the center axis of the nozzle body, the swirl of the fuel decreases during its flowing through the orifice. Such a decrease of the swirl leads to disturbance of spraying the fuel in the form of fine particles.

An object of the present invention is to provide a fuel injection nozzle for use in an internal combustion engine which serves for improving combustion efficiency.

SUMMARY OF THE INVENTION

According to one aspect of the present invention, there is provided a fuel injection nozzle for spraying a swirl of fuel, the fuel injection nozzle comprising:

a nozzle body having a bore, an orifice communicated with the bore, and a wall means defining the bore and the orifice, the bore having a first center axis, the orifice having a second center axis, an inlet open to the bore and an outlet open to outside the wall means;

the wall means including a first circumferential edge portion defining the inlet of the orifice and a second circumferential edge portion defining the outlet of the orifice;

a valve body axially movably disposed in the bore of the nozzle body; and a sprayed fuel body formed by fuel discharged from the orifice, the sprayed fuel body having a third center axis;

wherein the first circumferential edge portion of the wall means is so arranged as to allow the first center axis to be positioned inside the inlet to thereby prevent the swirl of fuel from decreasing, and the second circumferential edge portion of the wall means is so contoured as to allow at least a portion of the second circumferential edge portion to be out of a plane normal to the second center axis to thereby provide the sprayed fuel body of a predetermined configuration in which the third center axis is positioned in a predetermined relation to the first center axis.

According to further aspect of the present invention, there is provided in an internal combustion engine including a cylinder wall, a piston head, and a cylinder head wall which cooperate to define a chamber in the engine, two spaced intake valve heads within the chamber, and a fuel injection nozzle adapted to spray a swirl of fuel into the chamber, the fuel injection nozzle comprising:

a nozzle body having a bore, an orifice communicated with the bore, and a wall means defining the bore and the orifice, the bore having a first center axis, the orifice having a second center axis, an inlet open to the bore and an outlet open to outside the wall means;

the wall means including a first circumferential edge portion defining the inlet of the orifice and a second circumferential edge portion defining the outlet of the orifice;

a valve body axially movably disposed in the bore of the nozzle body; and a sprayed fuel body formed by fuel discharged from the orifice, the sprayed fuel body having a third center axis;

wherein the first circumferential edge portion of the wall means is so arranged as to allow the first center axis to be positioned inside the inlet to thereby prevent the swirl of fuel from decreasing, and the second circumferential edge portion of the wall means is so contoured as to allow at least a portion of the second circumferential edge portion to be out of a plane normal to the second center axis to thereby provide the sprayed fuel body of a predetermined configuration in which the third center axis is positioned in a predetermined relation to the first center axis, for ensuring fuel injection within the chamber to improve combustion efficiency.

DETAILED DESCRIPTION OF THE INVENTION

Figure 1:
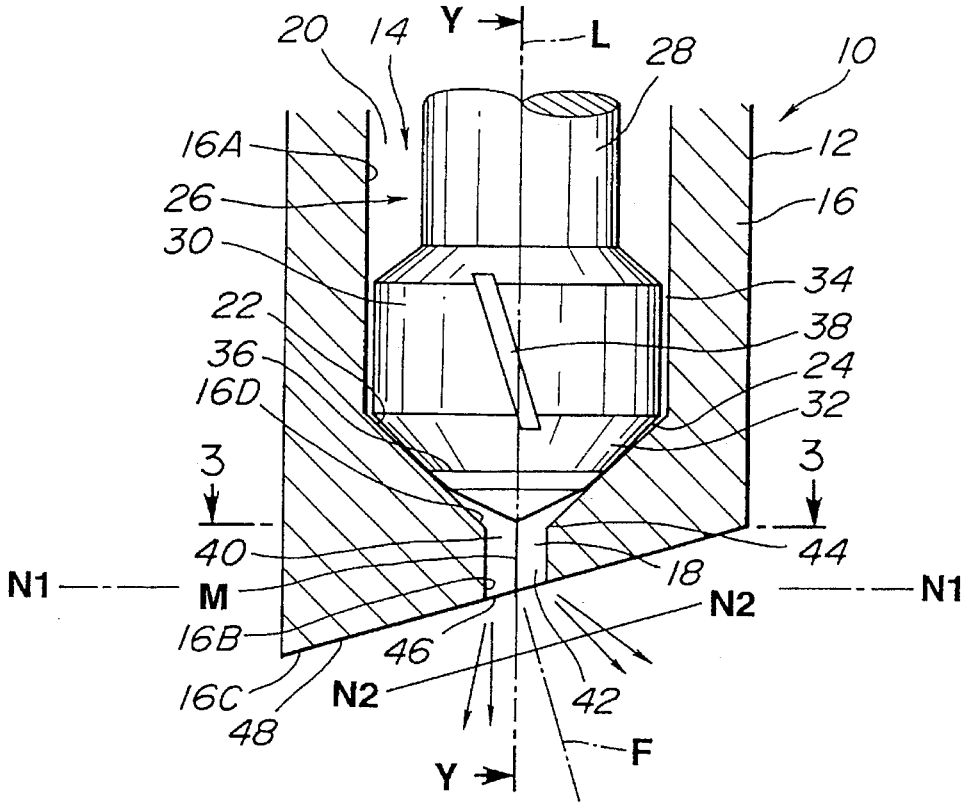
FIG. 1 is a sectional view of a fuel injection nozzle for use in an internal combustion engine, according to a first embodiment of the present invention, taken along plane X—X of FIG. 3 and showing an orifice.

Referring to the accompanying drawings, a fuel injection nozzle for use in an internal combustion engine, according to the present invention will now be explained. In the drawings, like reference numerals denote like or similar portions or parts.

Figure 2:
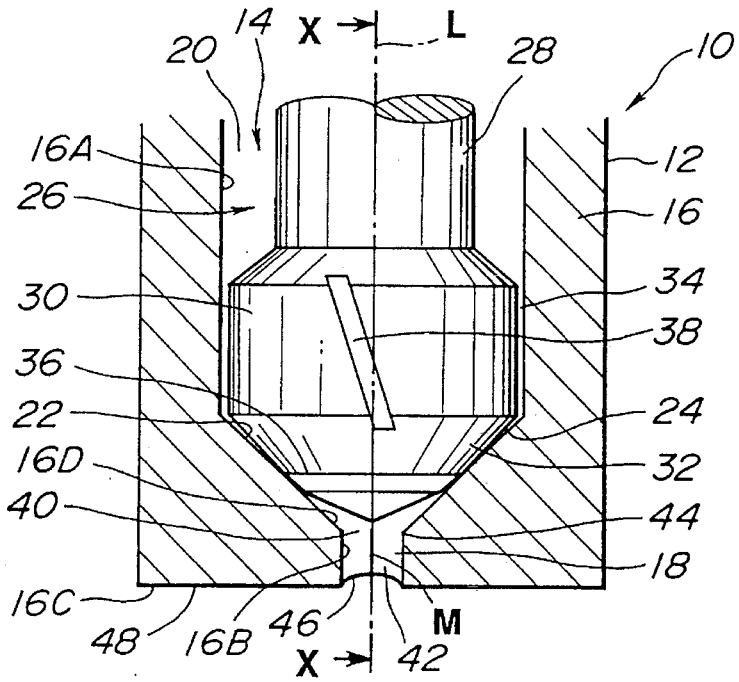
FIG. 2 is a view similar to FIG. 1, taken along plane Y—Y of FIG. 3.
Figure 3:
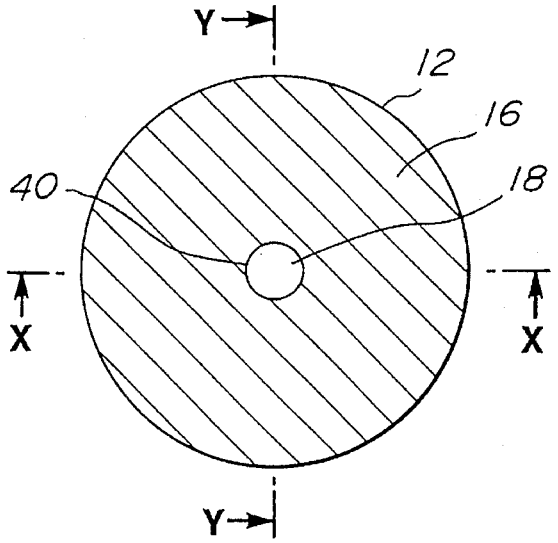
FIG. 3 is a sectional view taken along line 8—8 of FIG. 1.

As illustrated in FIGS. 1 and 2, the fuel injection nozzle 10 of the first embodiment includes a nozzle body 12 having a bore 14 and a wall 16 defining the bore 14. The bore 14 has a first center axis L and communicates with an orifice 18 having a second center axis M and extending outwardly through the wall 16. The first center axis L lies at the intersection of two perpendicular planes X—X and Y—Y as shown in FIG. 3. The wall 16 includes an inner surface 16A defining the bore 14, an annular surface 16B defining the orifice 18, and an outer bottom surface 16C. The bore 14 has an upstream cylindrical bore section 20 and a downstream frustoconical bore section 22 connected with the orifice 18. The frustoconical bore section 22 is defined by an inner circumferential sloped surface 16D of the wall 16 which acts as a valve seat 24 for a valve body 26. The valve body 26 is coaxially disposed with the nozzle body 12 and adapted to be reciprocally operated in the bore 14 in a suitable manner, for instance by means of solenoid. The valve body 26 has portions varying in cross-sectional areas, namely a trunk portion 28, a cylindrical portion 30 having a greater cross-sectional area than the trunk portion 28, and a conical portion 32 having a cross-sectional area which becomes smaller toward a tapered end thereof. An inlet passage 34 is defined by an annular gap between the inner surface of the wall 16 of the nozzle body 12 and the cylindrical portion 30 and conical section 32 of the valve body 24 opposed to the inner surface. The inlet passage 34 is connected to a source of pressurized fuel (not shown). Thus, the fuel is permitted to flow into the orifice 16 from the bore 14 through the inlet passage 34. The conical portion 32, specifically at a seating ridge portion 36 thereof, engages the valve seat 24 thereby closing the inlet passage 34 to prevent discharge of fuel through the orifice 16. A plurality of grooves 38 are formed on a circumferential surface of the cylindrical portion 30 in circumferentially spaced relation. For instance, there are provided four grooves 38 one of which is shown in FIG. 1. The grooves 38 extend along the circumferential surface toward the conical portion 32 and slant relative to the axial direction of the nozzle body 12. This provision of the grooves 38 causes a swirl of the fuel flowing through the inlet passage 34 and orifice 18.

The orifice 18 has an inlet 40 open into the frustoconical bore section 22 and an outlet 42 open to the outside of the nozzle body 12. The inlet 40 is defined by a first circumferential edge portion 44 of the wall 16 at which the annular surface 16B encounters the inner sloped surface 16D. The outlet 42 is defined by a second circumferential edge portion 46 of the wall 16 at which the annular surface 16B encounters the outer bottom surface 16C. Formed by fuel discharged from the outlet 42 of the orifice 18 is a sprayed fuel body having a third center axis F indicated in FIG. 1.

Figure 4:
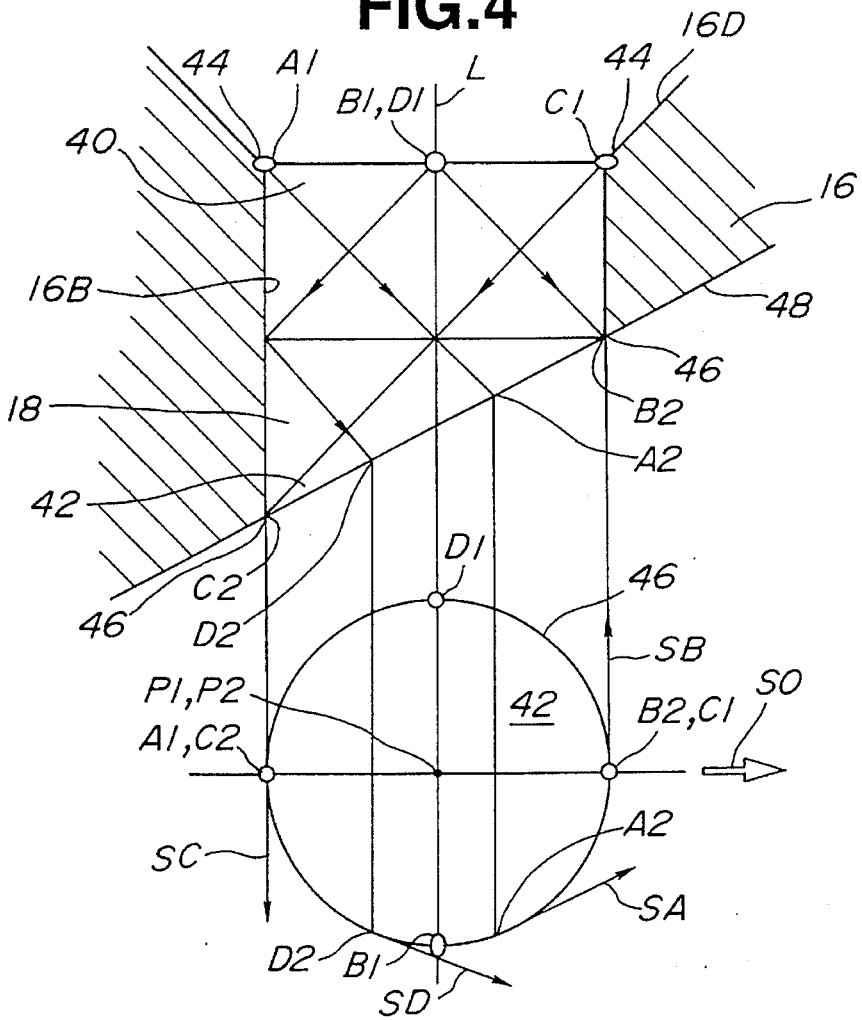
FIG. 4 is a diagram showing flow directions of a fuel flowing through the orifice of the fuel injection nozzle of FIG. 1.
Figure 5:
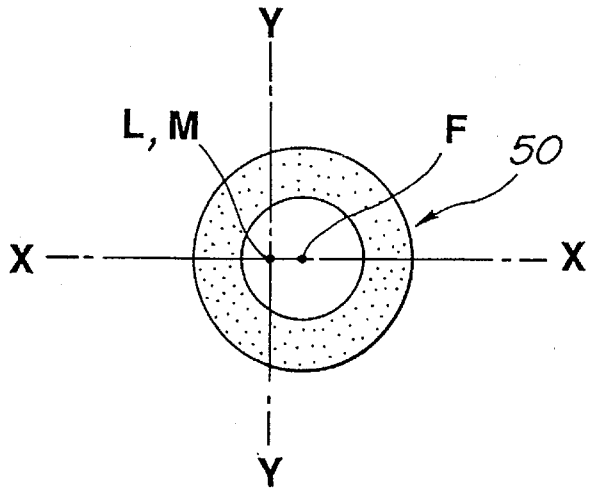
FIG. 5 is a schematic sectional view of a sprayed fuel body of fuel, taken along plane N2—N2 of FIG. 1.

In this first embodiment as shown in FIG. 4, both of the centers P1 and P2 of the inlet 40 and outlet 42 are located on the first center axis L of the bore 14. As illustrated in FIGS. 1 and 2, the first circumferential edge portion 44 is so arranged as to allow the first center axis L to be positioned inside the inlet 40, specifically at approximately the center P1 of the inlet 40. This arrangement of the first circumferential edge portion 44 causes the swirl of fuel flowing into the inlet 40 to be prevented from decreasing as compared with such an arrangement where the first center axis L is positioned outside the inlet 40. The closer to the first center axis L the center P1 of the inlet 40 is positioned, the more effectively a decrease of the swirl of fuel is restrained. The second circumferential edge portion 46 is arranged on the outer bottom surface 16C which is in the form of a slant plane 48 inclined with respect to the second center axis M. Namely, the second circumferential edge portion 46 is so arranged to be positioned out of the plane N1—N1 normal to the second center axis M of the orifice 18. This arrangement of the second circumferential edge portion 46 provides the sprayed fuel body of a predetermined configuration in which the third center axis F is offset and inclined relative to the first center axis L which coincide with the second center axis M. The predetermined configuration of the sprayed fuel body is a generally conical shape having a generally circular section as indicated at SO in FIG. 5, taken along a plane N2—N2 perpendicular to the third center axis F as shown in FIG. 1. Although the first embodiment employs the whole outer bottom surface 16C in the form of the slant plane 48, the slant plane 48 may be limited to a circumferential area where the outlet 42, namely the second circumferential edge portion 46 is disposed.

When the valve body 26 lifts up to open the inlet passage 34, fuel is swirled by passing through the grooves 38 and flows into the orifice 18 through the inlet 40 to spray from the outlet 42. Referring to FIG. 4, directions of the swirl of fuel flowing through the orifice 18 are now explained in detail, in which an enlarged view of the orifice 18 is shown at its upper part and the projection view of the outlet 42 of the orifice 18 is indicated at its lower part, the latter being the view projecting on a plane normal to the first center axis L. As illustrated in FIG. 4, when fuel swirlingly flows into the inlet 40, the fuel flows through points A1, B1, C1, and D1 positioned at the first circumferential edge portion 44 in flush relation. The fuel passing through these points A1 to D1 flows in such directions as indicated by arrows. When the fuel reaches the outlet 42, the fuel reaches points A2, B2, C2, and D2 positioned at the second circumferential edge portion 46 and sprays in directions indicated by arrows SA, SB, SC, and SD. Thus, the fuel flow has velocity components SA, SB, SC, and SD. At the time of spraying through the outlet 42, the fuel as a whole deflects in a direction S0, viz. toward the side of the point B2 at which a distance from the first circumferential edge 44 is smallest. The deflection degree of the fuel flow also depends upon viscosity of fuel. Thus, owing to the deflection of the fuel flow, there is provided the sprayed fuel body having the third center axis F inclined relative to the first and second center axes L and M, as shown in FIG. 1.

Figure 6:
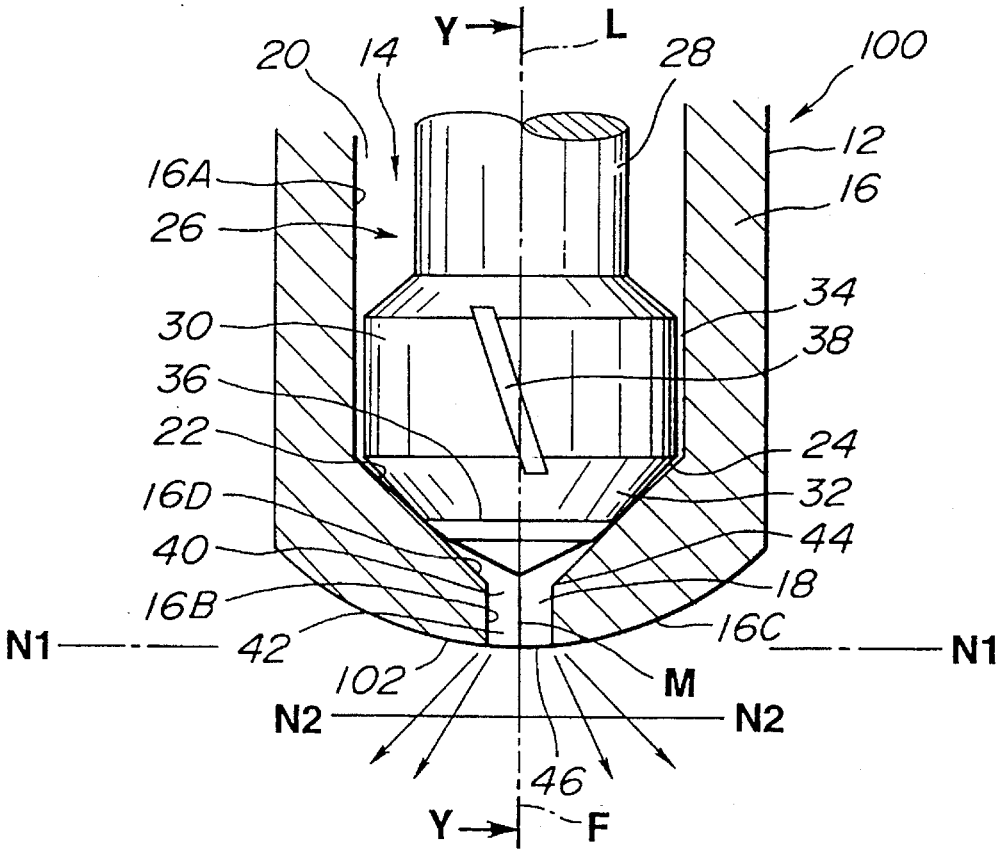
FIG. 6 is a sectional view of a second embodiment of the invention, taken along plane X—X of FIG. 3.
Figure 7:
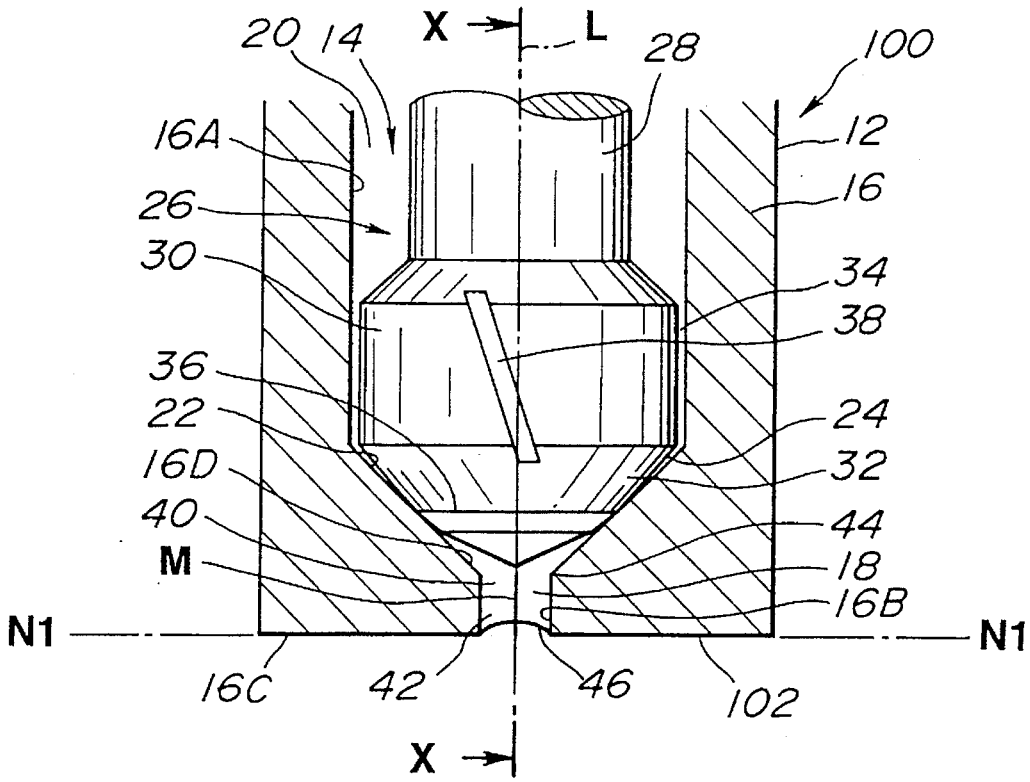
FIG. 7 is a sectional view similar to FIG. 6 but taken along plane Y—Y of FIG. 3.
Figure 8:
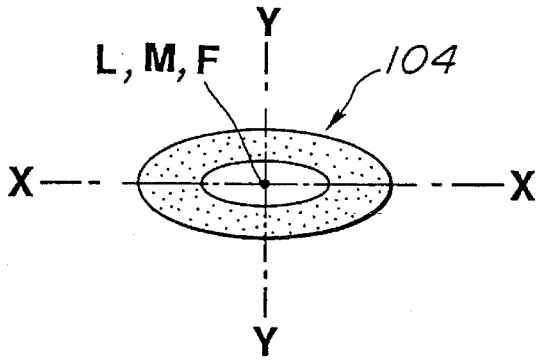
FIG. 8 is a schematic sectional view of a sprayed fuel body of fuel, taken along plane N2—N2 of FIG. 6.

Referring to FIGS. 6 and 7, a fuel injection nozzle 100 of the second embodiment will now be explained. Similarly to FIGS. 1 and 2 showing the first embodiment, FIGS. 6 and 7 illustrate sectional views taken along two intersecting planes X—X and Y—Y, respectively. The second circumferential edge portion 46 of the wall 16 of the nozzle body 12 is arranged on the outer bottom surface 16C provided in the form of a curved surface of a generally cylindrical segment. The center of the curved surface is positioned on the first center axis L of the bore 14 and the second center axis M of the orifice 18. The curved surface is indicated as an arcuate surface 102 as shown in FIG. 6. The second circumferential edge portion 46 is located on the arcuate surface 102 swelled outwardly or downwardly as viewed in FIG. 6. Thus, the arcuate surface 102 is disposed symmetrically with respect to the first and second center axes L and M. In the second embodiment, at least a portion of the second circumferential edge portion 46 of the wall 16 is arranged out of the plane N1—N1 normal to the second center axis M. The arcuate surface 102 may be limited to a circumferential area where the outlet 42, namely the second circumferential edge portion 46 is disposed. According to this embodiment, there is provided a sprayed fuel body of a predetermined configuration. The predetermined configuration is a generally conical shape having a generally ellipsoidal cross-section 104 as illustrated in FIG. 8. Owing to the afore-mentioned characteristics of the fuel flow deflection caused during spraying, the fuel sprays more widely in the direction extending along the plane X—X than in the direction extending along the plane Y—Y. Therefore, the fuel sprayed in such a direction is deflected outwardly so as to be close to the arcuate surface 102. Thus, the sprayed fuel body of the predetermined configuration has the third center axis F coincide with the first and second center axes L and M. As illustrated in FIG. 8, the ellipsoidal cross-section 104 of the sprayed fuel body has the major axis in the direction of the plane X—X and the minor axis in the direction of the plane Y—Y. The sprayed fuel body having the ellipsoidal cross-section 104 provides increased and reduced spray angles with respect to the directions X—X and Y—Y. This arrangement of the fuel injection nozzle in the engine serves for providing finely minimized particles of the fuel sprayed into a combustion chamber of the engine.

Figure 9:
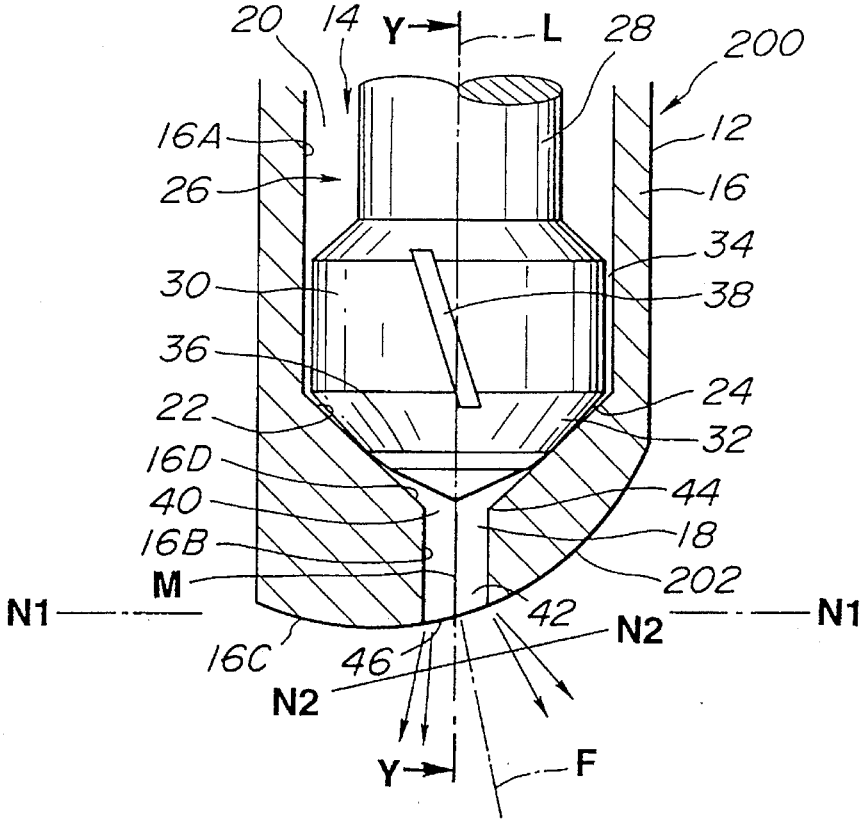
FIG. 9 is a sectional view of a third embodiment of the invention, taken along plane X—X of FIG. 3.
Figure 10:
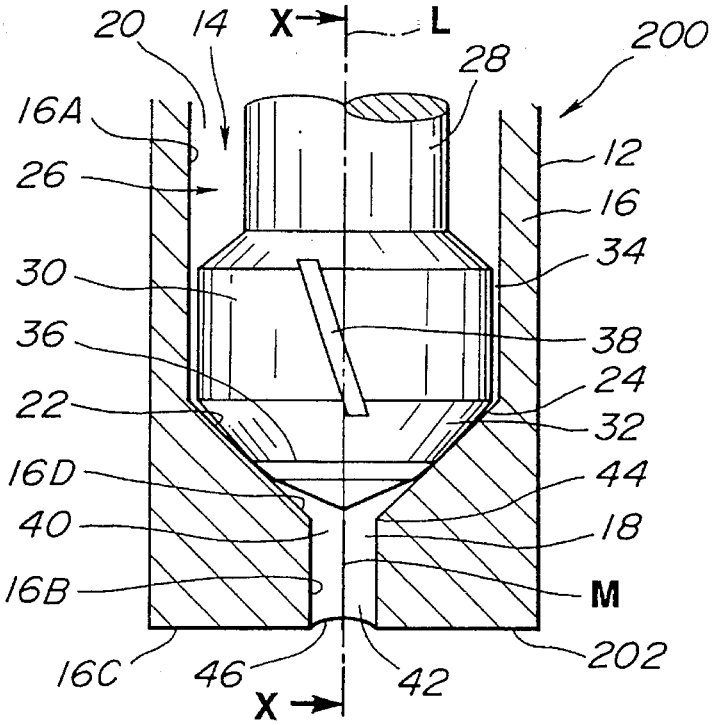
FIG. 10 is a sectional view similar to FIG. 9 but taken along plane Y—Y of FIG. 3.
Figure 11:
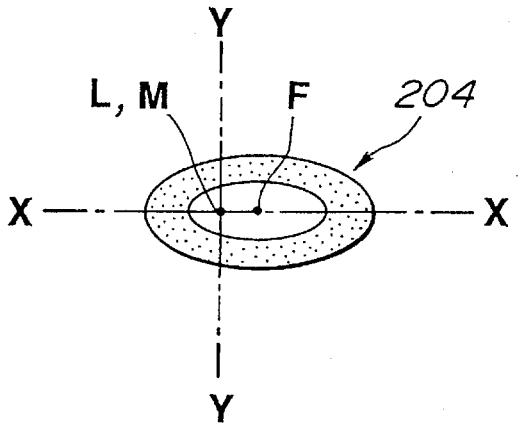
FIG. 11 is a schematic sectional view of a sprayed fuel body of fuel, taken along plane N2—N2 of FIG. 9.

Referring to FIGS. 9 and 10, a fuel injection nozzle 200 of the third embodiment is now explained. Similarly to FIGS. 1 and 2 showing the first embodiment, FIGS. 9 and 10 illustrate sectional views taken along two intersecting planes X—X and Y—Y, respectively. The second circumferential edge portion 46 of the wall 16 of the nozzle body 12 is arranged on the outer bottom surface 16C provided in the form of a curved surface of a generally cylindrical segment. The center of the curved surface is out of the first center axis L of the bore 14 and the second center axis M of the orifice 18. The curved surface is indicated as an arcuate surface 202 swelled outwardly or downwardly as viewed in FIG. 9. As illustrated in FIG. 9, the arcuate surface 202 is disposed in the plane X—X asymmetrically with respect to the first and second center axes L and M. In the third embodiment, similarly to the second embodiment, at least a portion of the second circumferential edge portion 46 of the wall 16 is arranged out of the plane N1—N1 normal to the second center axis M. The arcuate surface 202 may be limited to a circumferential area where the outlet 42, namely the second circumferential edge portion 46 is disposed. According to this embodiment, there is provided a sprayed fuel body of a predetermined configuration, viz. a generally conical shape having a generally ellipsoidal cross-section 204 as illustrated in FIG. 11. Owing to the afore-mentioned characteristics of the fuel flow deflection caused during spraying, the fuel sprays more widely in the direction extending along the plane X—X than in the direction extending along the plane Y—Y. The sprayed fuel body has the third center axis F offset from and inclined with respect to the first and second center axes L and M. As illustrated in FIG. 11, the ellipsoidal cross-section 204 of the sprayed fuel body has the major axis in the direction of the plane X—X and the minor axis in the direction of the plane Y—Y. Thus, the sprayed fuel body having the ellipsoidal cross-section 204 performs function and exhibits effects similar to those of the second embodiment and therefore detailed explanations therefor are omitted.

Figure 12:
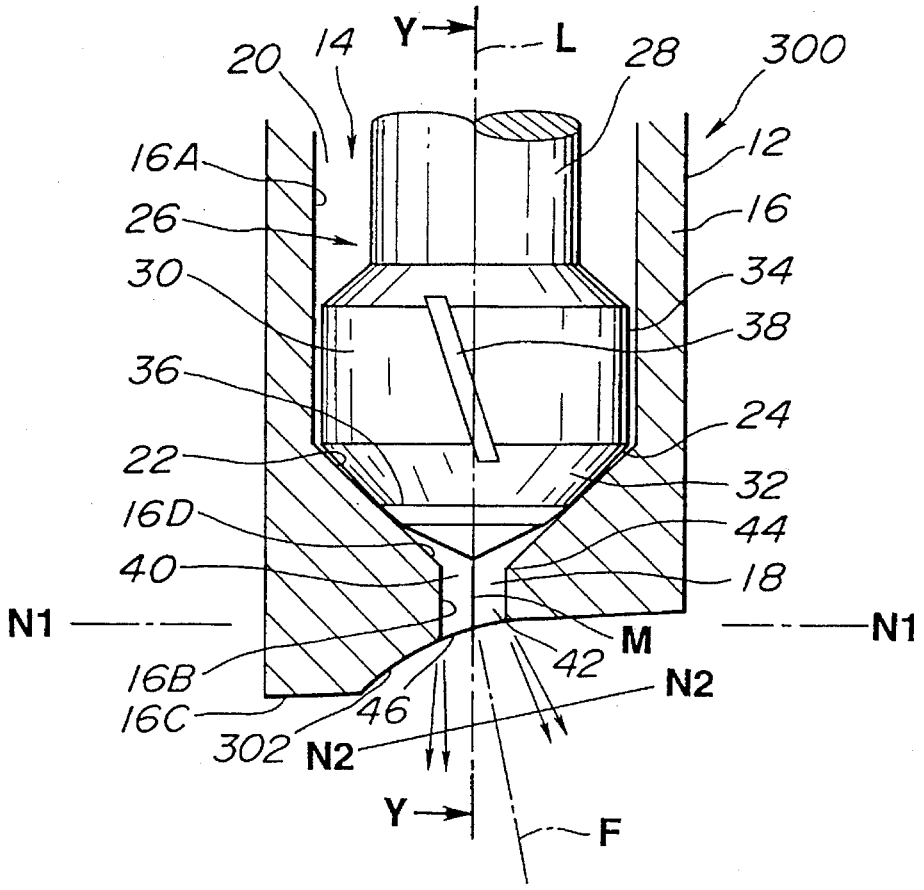
FIG. 12 is a sectional view of a fourth embodiment of the invention, taken along plane X—X of FIG. 3.
Figure 13:
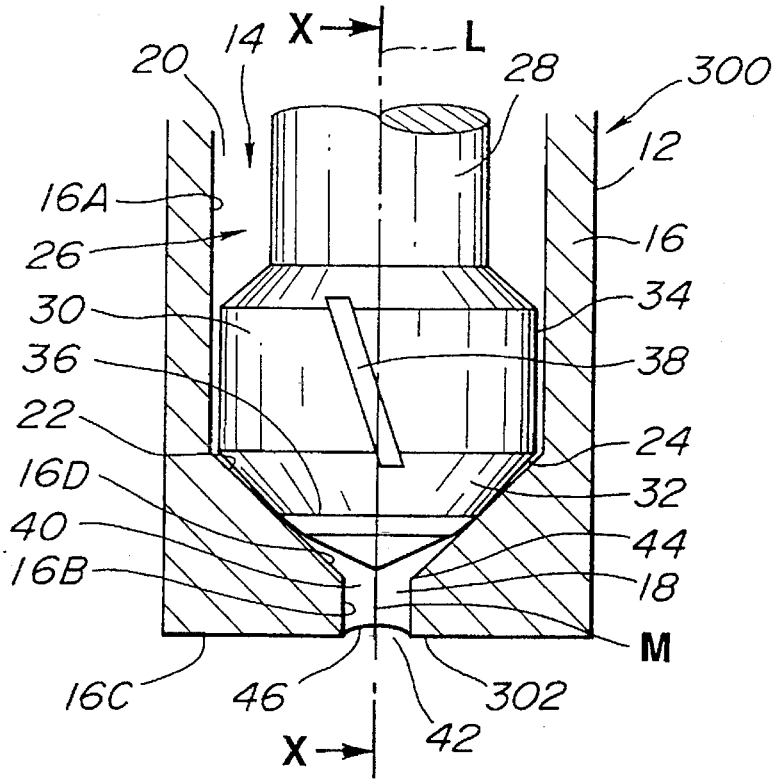
FIG. 13 is a sectional view similar to FIG. 12 but taken along plane Y—Y of FIG. 3.
Figure 14:
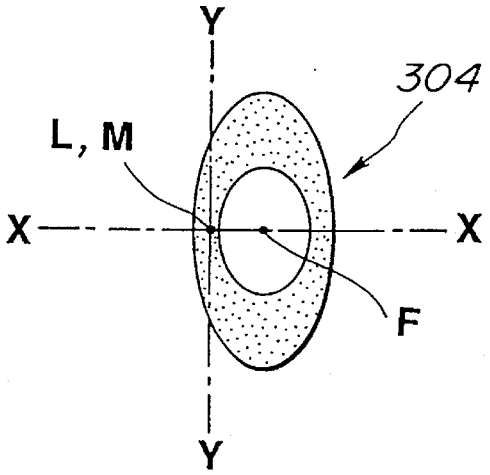
FIG. 14 is a schematic sectional view of a sprayed fuel body of fuel, taken along plane N2—N2 of FIG. 12.

Referring to FIGS. 12 and 13, a fuel injection nozzle 300 of the fourth embodiment is now explained. Similarly to FIGS. 1 and 2 for the first embodiment, FIGS. 12 and 13 illustrate sectional views taken along two intersecting planes X—X and Y—Y, respectively. The second circumferential edge portion 46 of the wall 16 of the nozzle body 12 is arranged on the outer bottom surface 16C provided in the form of a concave surface 302 curved inwardly toward the bore 14 as shown in FIG. 12. As illustrated in FIG. 12, the concave surface 302 has a section taken along the plane X—X, asymmetrical with respect to the first and second center axes L and M. In the fourth embodiment, similarly to the afore-mentioned embodiments, at least a portion of the second circumferential edge portion 46 of the wall 16 is arranged out of the plane N1—N1 normal to the second center axis M. The concave surface 802 may be limited to an area where the outlet 42, namely the second circumferential edge portion 46 is disposed. According to this embodiment, there is provided a sprayed fuel body of a predetermined configuration, viz. a generally conical shape having a generally ellipsoidal cross-section 304 illustrated in FIG. 14. Owing to the aforementioned characteristics of the fuel flow deflection caused during spraying, the fuel sprays more narrowly in the direction extending along the plane X—X than in the direction extending along the plane Y—Y. Therefore, the fuel splayed in the direction is deflected inwardly so as to be away from the concave surface 302. The predetermined configuration of the sprayed fuel body has the third center axis F offset from and inclined with respect to the first and second center axes L and M. As shown in FIG. 14, the ellipsoidal cross-section 804 of the sprayed fuel body has the minor axis in the direction of the plane X—X and the major axis in the direction of the plane Y—Y. Thus, the major and minor axes of the ellipsoidal cross-section 304 have a relation reverse to those of the ellipsoidal cross-section 204 in the third embodiment.

Figure 15:
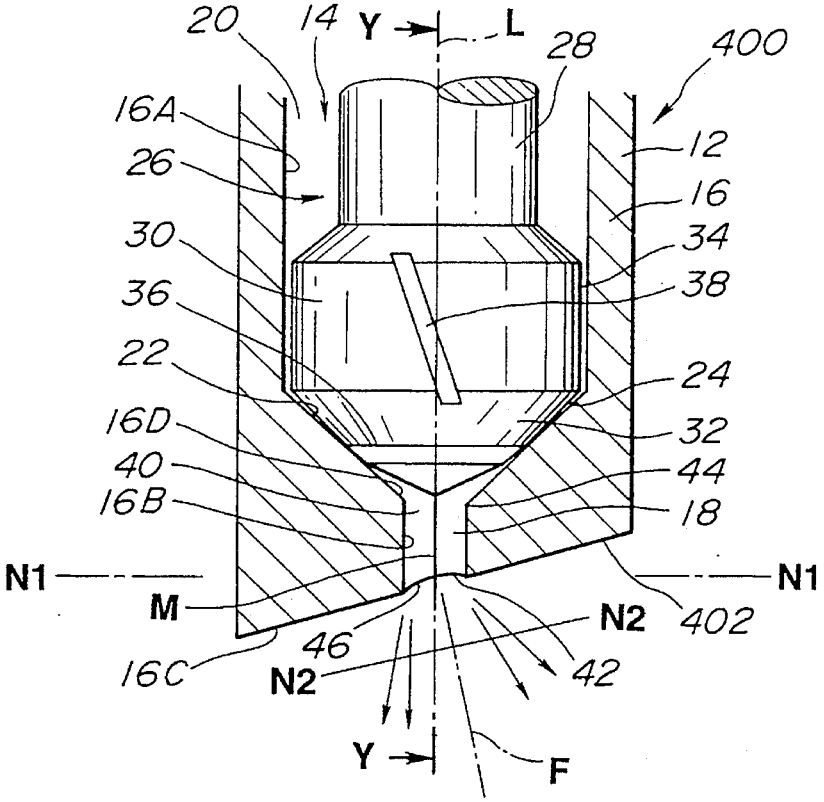
FIG. 15 is a sectional view of a fifth embodiment of the invention, taken along plane X—X of FIG. 3.
Figure 16:
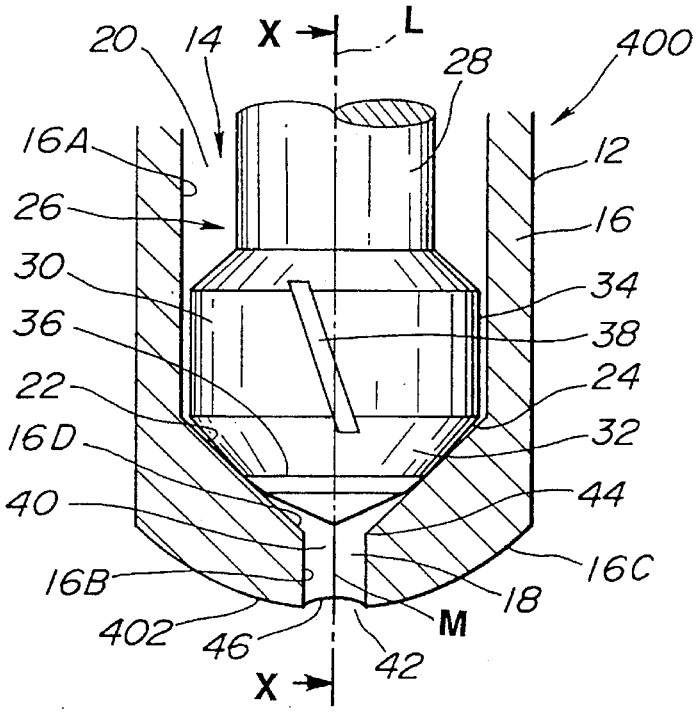
FIG. 16 is a sectional view similar to FIG. 15 but taken along plane Y—Y of FIG. 3.
Figure 17:
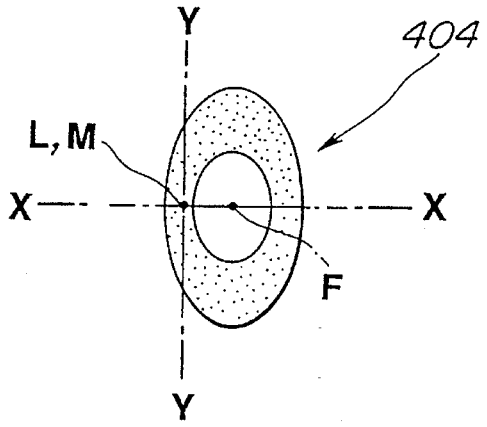
FIG. 17 is a schematic sectional view of a sprayed fuel body of fuel, taken along plane N2—N2 of FIG. 15.

Referring to FIGS. 15 and 16, a fuel injection nozzle 400 of the fifth embodiment will now be explained. Similarly to FIGS. 1 and 2 for the first embodiment, FIGS. 15 and 16 illustrate sectional views taken along two intersecting planes X—X and Y—Y, respectively. The second circumferential edge portion 46 of the wall 16 of the nozzle body 12 is arranged on the outer bottom surface 16C provided in the form of a curved surface of a generally conical segment. The center of the curved surface is positioned on the first center axis L of the bore 14 and thus the second center axis M coincide with the first center axis L. The curved surface is indicated at 402 in FIG. 16. The second circumferential edge portion 46 is located on the curved surface 402 swelled outwardly or downwardly as viewed in FIG. 16. Thus, the curved surface 402 is disposed in the plane Y—Y symmetrically with respect to the first and second center axes L and M. As illustrated in FIG. 15, the curved surface 402 has a section inclined with respect to the first center axis L. Thus, in the fifth embodiment, similarly to the afore-mentioned embodiments, at least a portion of the second circumferential edge portion 46 of the wall 16 is arranged out of the plane N1—N1 normal to the second center axis M. The curved surface 402 may be limited to only an area where the outlet 42, namely the second circumferential edge portion 46 is disposed. FIG. 17 shows a generally ellipsoidal cross-section 404 of a sprayed fuel body with a predetermined configuration. Owing to the afore-mentioned characteristics of the fuel flow deflection caused during spraying, the fuel sprays more narrowly in the direction extending along the plane X—X than in the direction extending along the plane Y—Y. Therefore, the fuel sprayed in the direction is deflected inwardly so as to be remote from the curved surface 402. The predetermined configuration of the sprayed fuel body is in the form of a generally conical shape having the third center axis F offset and inclined relative to the first center axis L and second center axis M coincide with the first center axis L. As illustrated in FIG. 17, the ellipsoidal cross-section 404 of the sprayed fuel body has the major axis in the direction of the plane Y—Y and the minor axis in the direction of the plane X—X.

Figure 18:
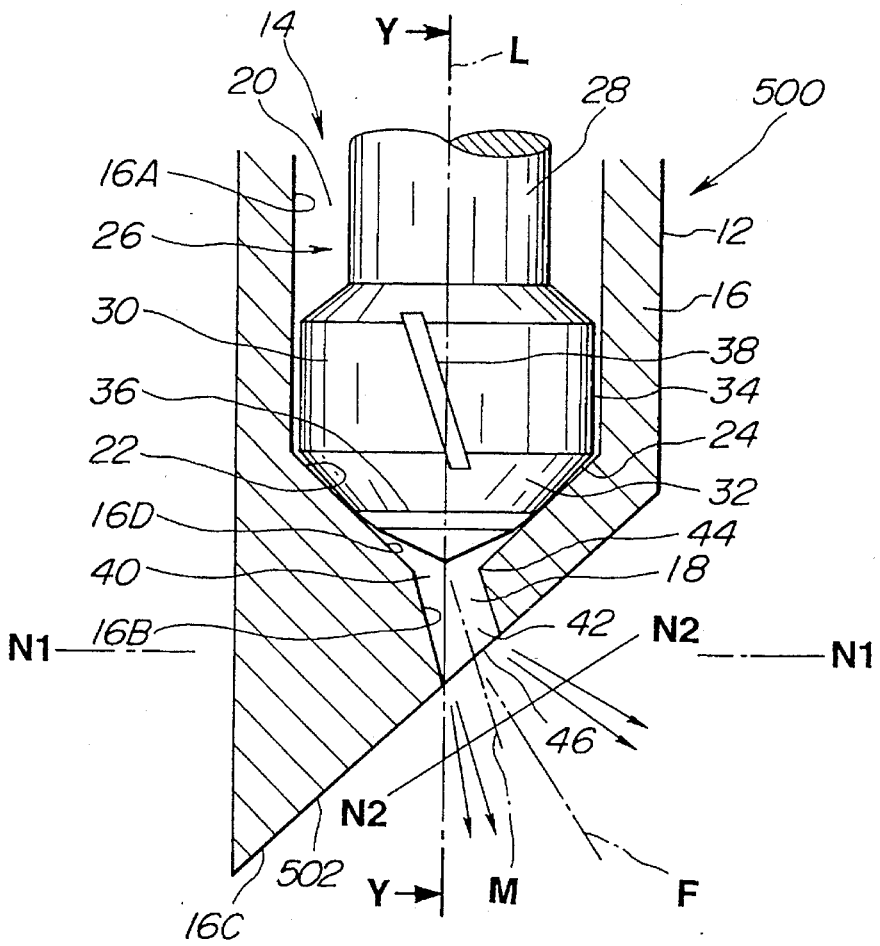
FIG. 18 is a sectional view of a sixth embodiment of the invention, taken along plane X—X of FIG. 3.
Figure 19:
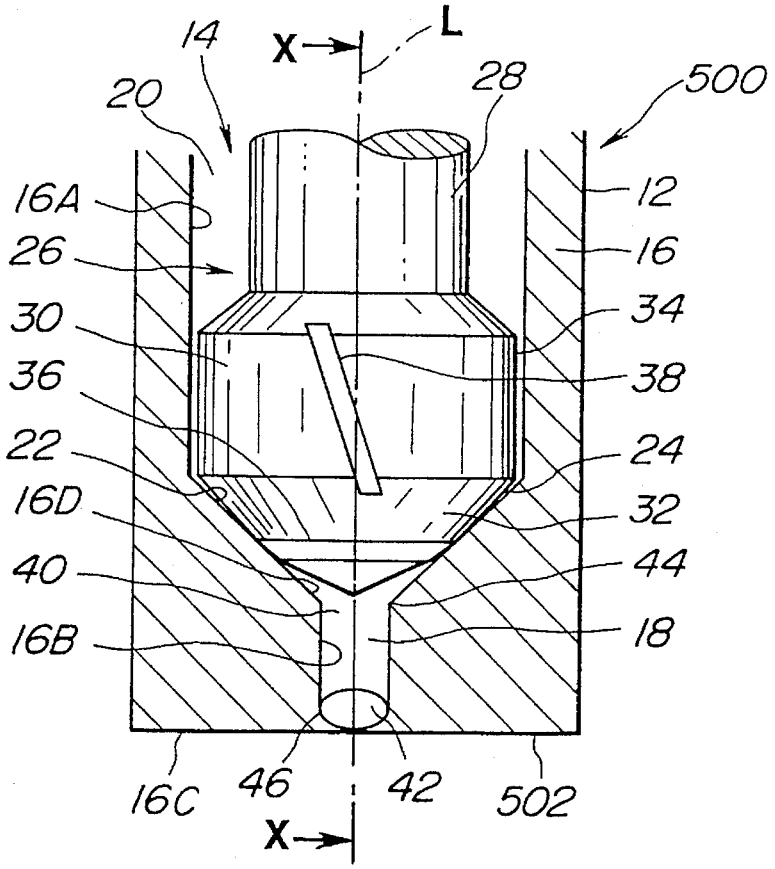
FIG. 19 is a sectional view similar to FIG. 18 but taken along plane Y—Y of FIG. 3.
Figure 20:
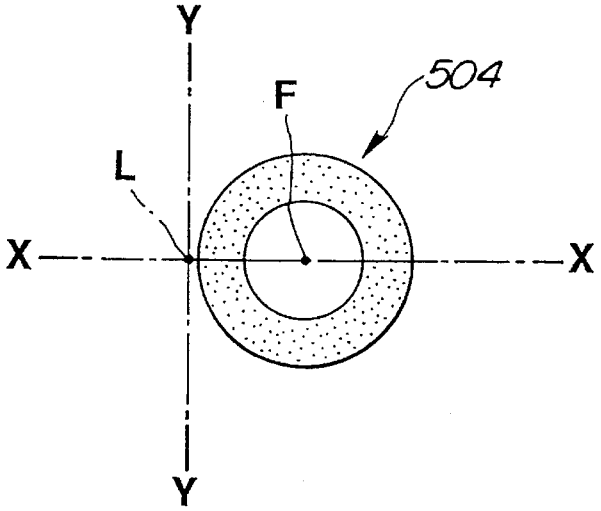
FIG. 20 is a schematic sectional view of a sprayed fuel body of fuel, taken along plane N2—N2 of FIG. 18.

Referring to FIGS. 18 and 19, a fuel injection nozzle 500 of the sixth embodiment will be explained hereinafter. Similarly to FIGS. 1 and 2 for the first embodiment, FIGS. 18 and 19 illustrate sectional views taken along two intersecting planes X—X and Y—Y, respectively. As shown in FIG. 18, the orifice 18 is defined by the annular surface 16B of the wall 16 of the nozzle body 12 such that the second center axis M thereof is offset from and inclined with respect to the first center axis L. The second circumferential edge portion 46 of the wall 16 is arranged in a slant plane 502 inclined with respect to the second center axis M. Namely, the second circumferential edge portion 46 is so contoured as to allow at least a portion thereof to be out of the plane N1—N1 normal to the second center axis M of the orifice 18. This arrangement of the second circumferential edge portion 46 provides a sprayed fuel body of a predetermined configuration. The predetermined configuration is in the form of a generally conical shape having the third center axis F inclined relative to both the second center axis M and the first center axis L inclined relative to the second center axis M as shown in FIG. 18. This causes the fuel to spray in more offset relation to the first center axis L. The predetermined configuration of the sprayed fuel body is a generally conical shape having a generally circular cross-section 504 as shown in FIG. 20, taken along the plane N2—N2 of FIG. 18 perpendicular to the third center axis F. In this embodiment, since the center of the inlet 40 is located approximately on the first center axis L, the fuel provided with swirl component by the groove 38 flows into the orifice 18 with substantially no decrease of the swirl. Although in the sixth embodiment, the whole outer bottom surface 16C is in the form of the slant plane 502, the slant plane 502 may be limited to only an area where the outlet 42, namely the second circumferential edge portion 46 is disposed.

Figure 21:
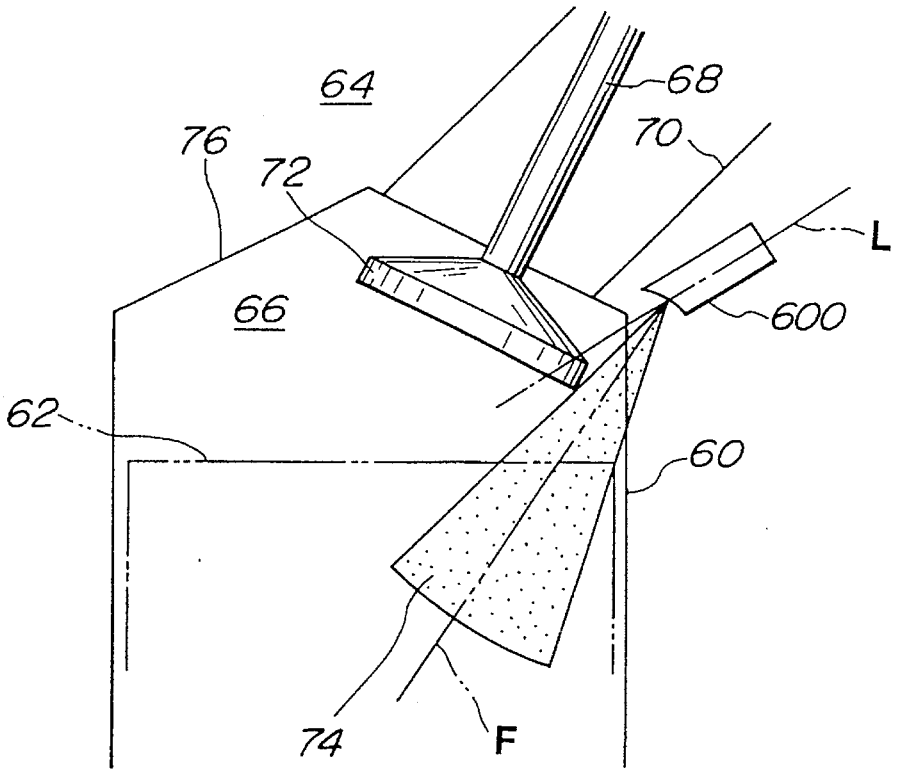
FIG. 21 is a schematic sectional view showing a part of the engine in which the fuel injection nozzle of the fourth embodiment is arranged, and the sprayed fuel body of fuel injected therefrom.
Figure 22:
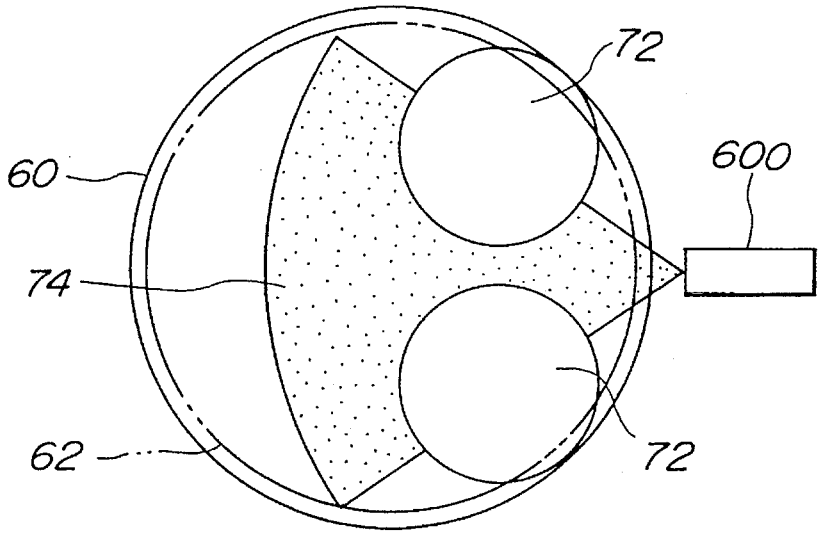
FIG. 22 is a schematic diagram showing the sprayed fuel body of fuel as viewed from a different direction in FIG. 21.

Referring to FIG. 21, a fuel injection nozzle 600 similar to the fourth embodiment is applied to an internal combustion engine. The engine includes a cylinder wall 60, a piston head 62 and a cylinder head 64, which cooperate to define a chamber 66 in the engine. Two spaced intake valves 68, one of which is indicated in FIG. 21, are disposed in an intake port 70 provided in the cylinder head 64. A valve head 72 of each of the intake valves 68 is movable within the chamber 66 in opposed relation to the piston head 82. The fuel injection nozzle 600 is so arranged below the intake port 70 as to inject Fuel toward the chamber 86. The fuel injection nozzle 600 provides a sprayed fuel body of a predetermined configuration having the third center axis F inclined, downwardly as viewed in FIG. 21, relative to the first center axis L of the fuel injection nozzle 600. The predetermined configuration is in the form of a first pattern 74 as shown in FIG. 22. The first pattern 74 is disposed Between the cylinder wall 60 and the valve head 72 as shown in FIG. 21, and allows the sprayed fuel body to cover such an area of the, piston head 62 as illustrated in FIG. 22. This arrangement ensures the fuel injection to the piston head 62 by reducing the fuel injection to the valve heads 72. In addition, this arrangement serves for improving exhaust emission which is disturbed by splashing-back of the fuel from the piston head 62 to a cylinder head wall 76 of the cylinder head 64 which is opposed to the chamber 66. This splashing-back of fuel is restricted in a following manner. Namely, upon re-start of the fuel injection, the fuel is less swirled or deflected and therefore injects straightly along the first center axis L to impinge on the piston head 62 at more obtuse angle. Thus, the impingement at the more obtuse angle leads to limitation of fuel splashing-back on the piston head 62.

Figure 23:
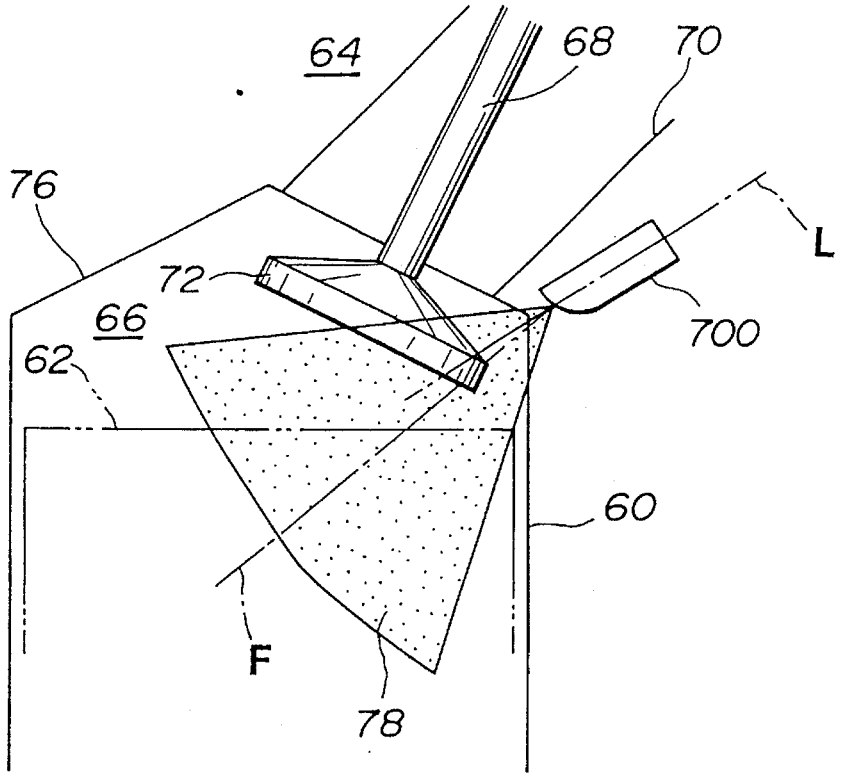
FIG. 23 is a view similar to FIG. 21 but in which the fuel injection nozzle of the third embodiment is arranged, showing the sprayed fuel body of fuel injected from the nozzle.
Figure 24:
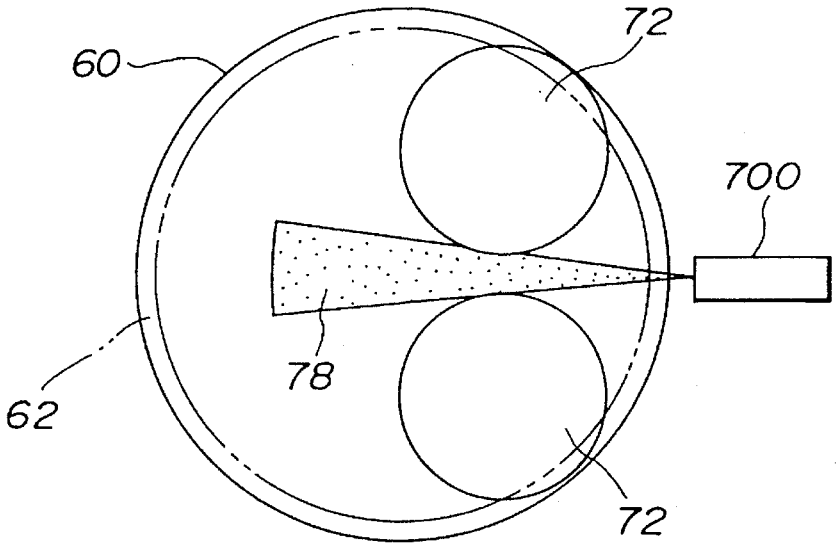
FIG. 24 is a schematic diagram showing the sprayed fuel body of fuel as viewed from a different direction in FIG. 23.

Referring to FIG. 23, a fuel injection nozzle 700 similar to the third embodiment is applied to an internal combustion engine. The engine of FIG. 23 has substantially same structure as of FIG. 21 and therefore like reference numerals denote like parts. The fuel injection nozzle 700 is arranged similar to the fuel injection nozzle 600 of FIG. 21. The fuel injection nozzle 700 provides a sprayed fuel body of a predetermined configuration having the third center axis F inclined, downwardly as viewed in FIG. 23, relative to the first center axis L of the fuel injection nozzle 700. The predetermined configuration is in the form of a second pattern 78 as shown in FIG. 24. The second pattern 78 is disposed between the two spaced valve heads 72 and allows the sprayed fuel body to cover such an area of the piston head 62 as illustrated in FIG. 24. If a fuel injection nozzle 700 of the second embodiment is used instead of the fuel injection nozzle 600 of the third embodiment, the second pattern 78 is provided. This arrangement ensures the fuel injection to the piston head 62 by reducing the fuel injection to the valve heads 72, as well as the arrangement as indicated in FIG. 21.

Figure 25:
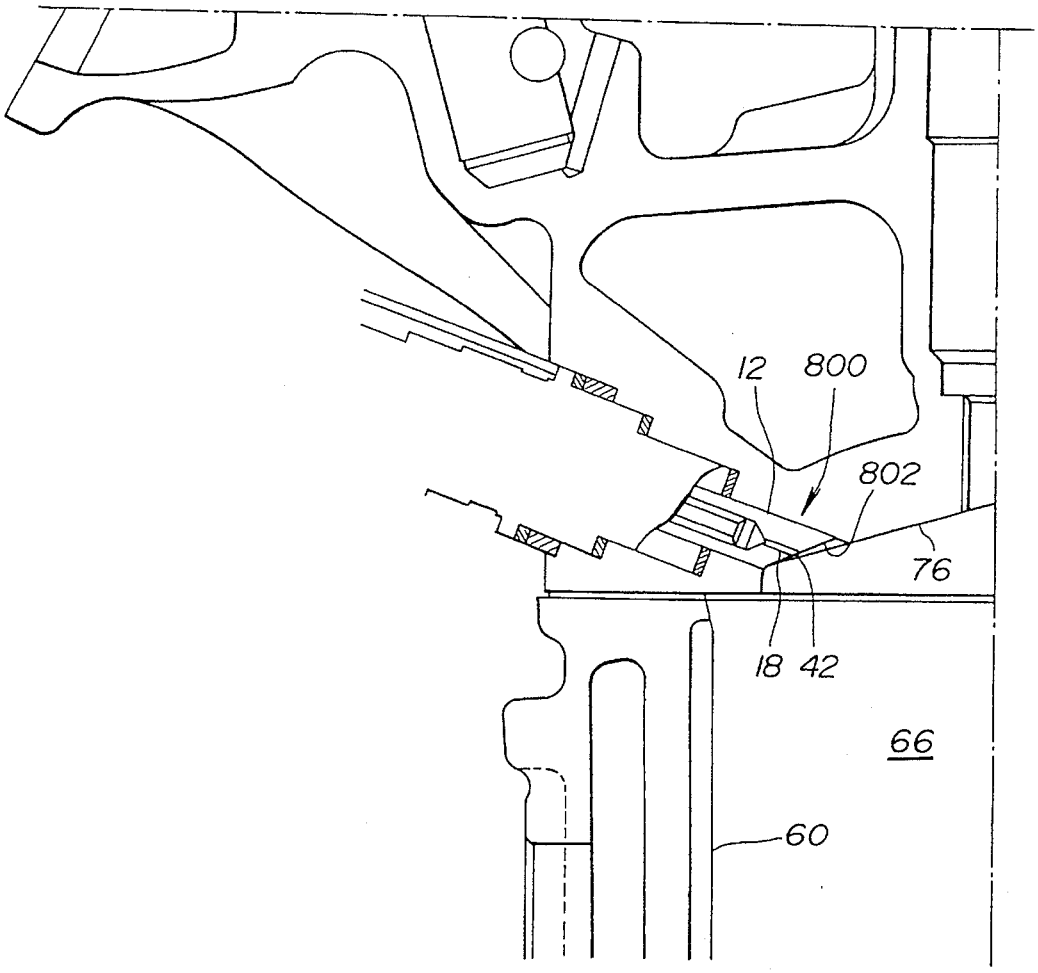
FIG. 25 is a schematic sectional view showing a part of the engine in which the fuel injection nozzle of the first embodiment is arranged.

Referring to FIG. 25, a fuel injection nozzle 800 similar to the first embodiment is applied to an internal combustion engine. The engine has a structure similar to FIG. 21 and therefore like reference numerals denote like parts. The fuel injection nozzle 800 includes the nozzle body 12 having a slant plane 802 in which the outlet 42 of the orifice 18 is arranged. The slant plane 802 is so designed as to be substantially flush with an outer surface of the cylinder head wall 76 upon mounting. This arrangement serves for reducing accumulation of sprayed fuel on a portion of the outer surface of the cylinder head wall 76 which is disposed adjacent the nozzle body 12.

Figure 26:
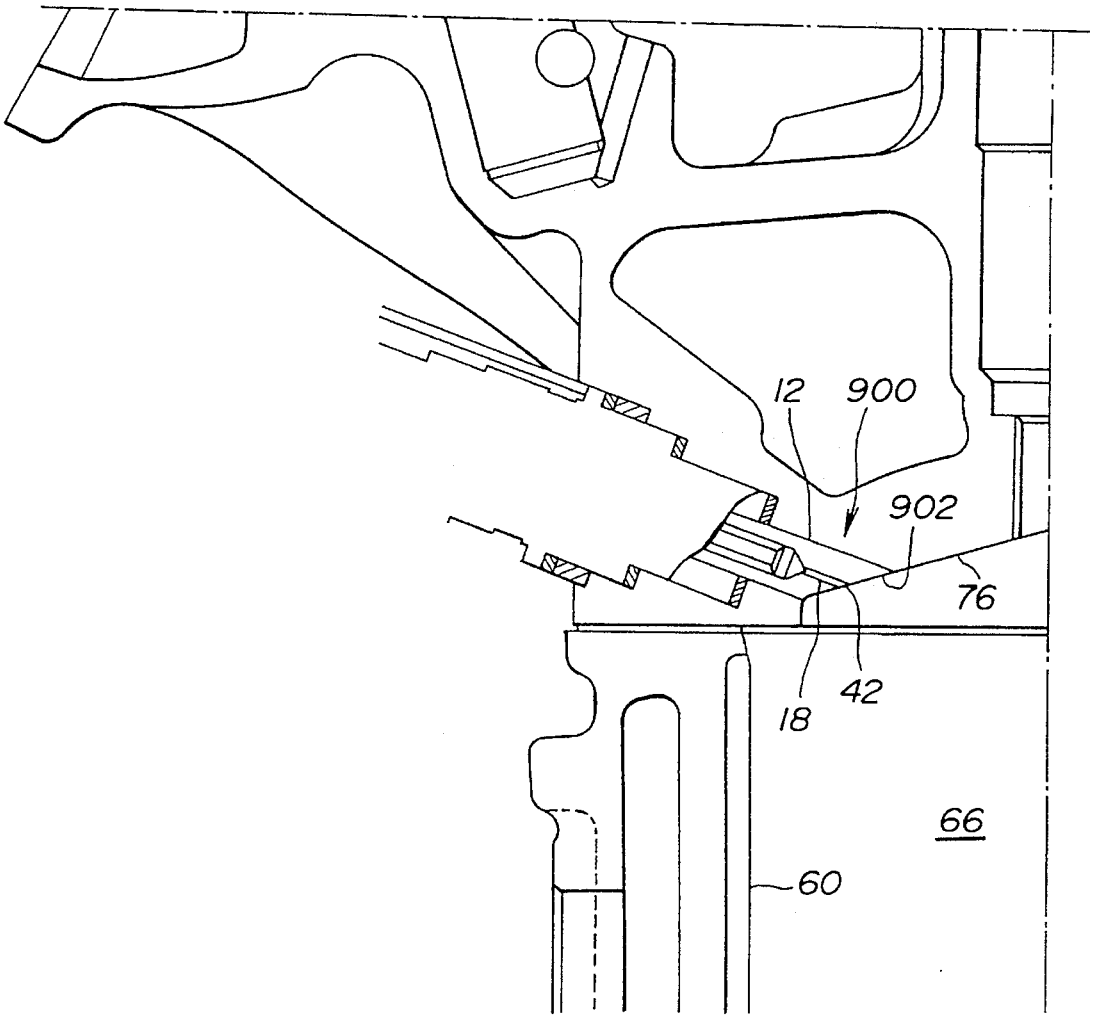
FIG. 26 is a view similar to FIG. 25 but showing a modified fuel injection nozzle.

Referring to FIG. 26, a fuel injection nozzle 900 similar to the first embodiment is applied to the internal combustion engine constructed similar to the engine of FIG. 21 and therefore like reference numerals denote like parts. As well as the fuel injection nozzle 800 of FIG. 25, the nozzle body 12 of the fuel injection nozzle 900 has a slant plane 902 in which the outlet 42 of the orifice 18 is arranged. The slant plane 902 is so designed as to be flush with the outer surface of the cylinder head wall 76 upon mounting. Owing to this arrangement, sprayed fuel is prevented from being accumulated on the portion of the outer surface of the cylinder head wall 76 which is disposed adjacent the nozzle body 12.

As is appreciated from the above description, the fuel injection nozzle according to the present invention ensures fuel injection within the chamber to thereby improve combustion efficiency.

What is claimed is:

1. A fuel injection nozzle for spraying a swirl of fuel, said fuel injection nozzle comprising:

a nozzle body having a bore, an orifice communicated with said bore, and a wall means defining said bore and said orifice, said bore having a first center axis, said orifice having a second center axis, an inlet open to said bore and an outlet open to outside said wall means;

said wall means including a first circumferential edge portion defining said inlet of said orifice and a second circumferential edge portion defining said outlet of said orifice;

a valve body axially movably disposed in said bore of said nozzle body; and a sprayed fuel body formed by fuel discharged from said orifice, said sprayed fuel body having a third center axis;

wherein said first circumferential edge portion of said wall means is so arranged as to allow said first center axis to be positioned inside said inlet to thereby prevent the swirl of fuel from decreasing, and said second circumferential edge portion of said wall means is so contoured as to allow at least a portion of said second circumferential edge portion to be out of a plane normal to said second center axis to thereby provide said sprayed fuel body of a predetermined configuration in which said third center axis is positioned in a predetermined relation to said first center axis.

2. A fuel injection nozzle as claimed in claim 1, wherein said third center axis is positioned in inclined relation to said First center axis.

3. A fuel injection nozzle as claimed in claim 2, wherein said third center axis is positioned in inclined relation to said second center axis.

4. A fuel injection nozzle as claimed in claim 2, wherein said second circumferential edge portion of said wall means is arranged in a plane slant with respect to said second center axis.

5. A fuel injection nozzle as claimed in claim 1, wherein said second circumferential edge portion of said wall means is arranged on a curved surface with respect to said second center axis.

6. A fuel injection nozzle as claimed in claim 2, wherein said second circumferential edge portion of said wall means is arranged on a curved surface swelled outwardly toward outside of said wall means.

7. A fuel injection nozzle as claimed in claim 2, wherein said second circumferential edge portion of said wall means is arranged on a concave surface curved inwardly toward said bore.

8. A fuel injection nozzle as claimed in claim 6, wherein said wall means having said curved surface has a section inclined with respect to said first center axis.

9. A fuel injection nozzle as claimed in claim 3, wherein said second circumferential edge portion of said wall means is arranged in a plane slant with respect to said second center axis.

10. In an internal combustion engine including a cylinder wall, a piston head, and a cylinder head wall which cooperate to define a chamber, two spaced intake valve heads within the chamber, and a fuel injection nozzle adapted to spray a swirl of fuel into the chamber, said fuel injection nozzle comprising:

a nozzle body having a bore, an orifice communicated with said bore, and a wall means defining said bore and said orifice, said bore having a first center axis, said orifice having a second center axis, an inlet open to said bore and an outlet open to outside said wall means;

said wall means including a first circumferential edge portion defining said inlet of said orifice and a second circumferential edge portion defining said outlet of said orifice;

a valve body axially movably disposed in said bore of said nozzle body; and a sprayed fuel body formed by fuel discharged from said orifice, said sprayed fuel body having a third center axis;

wherein said first circumferential edge portion of said wall means is so arranged as to allow said first center axis to be positioned inside said inlet to thereby prevent the swirl of fuel from decreasing, and said second circumferential edge portion of said wall means is so contoured as to allow at least a portion of said second circumferential edge portion to be out of a plane normal to said second center axis to thereby provide said sprayed fuel body of a predetermined configuration in which said third center axis is positioned in a predetermined relation to said first center axis, for ensuring fuel injection within the chamber to improve combustion efficiency.

11. An internal combustion engine as claimed in claim 10, wherein said third center axis is positioned in inclined relation to said first center axis.

12. An internal combustion engine as claimed in claim 10, wherein said wall means has a slant plane designed to be flush with an outer surface of the cylinder head wall.

* * * * *